United States Patent [19]

Smith et al.

[11] Patent Number: 4,545,360

[45] Date of Patent: Oct. 8, 1985

[54] CLEAN BURNING SOLID FUEL STOVE AND METHOD

[76] Inventors: Richard D. Smith, 2415 South Court, Palo Alto, Calif. 94301; Samuel J. Van Grouw, 1142 Blythe St., Foster City, Calif. 94404

[21] Appl. No.: 553,785

[22] Filed: Nov. 21, 1983

[51] Int. Cl.[4] ..... F24B 5/04

[52] U.S. Cl. ..... 126/76; 126/61; 126/77; 126/80; 126/163 A; 126/123; 110/315

[58] Field of Search ..... 126/60, 61, 62, 64, 126/65, 66, 77, 76, 80, 163 A, 164, 165, 58; 110/162, 315; 237/51, 55

[56] References Cited

U.S. PATENT DOCUMENTS

| | | | |
|---|---|---|---|
| 3,269,383 | 8/1966 | Maasberg | 126/164 |
| 4,182,304 | 1/1980 | Mele | 126/77 |
| 4,194,487 | 3/1980 | Cadwallader et al. | 126/76 |
| 4,291,669 | 9/1981 | Herne, Jr. | 126/83 |
| 4,300,526 | 11/1981 | McKay et al. | 126/67 |
| 4,316,444 | 2/1982 | Gullickson | 126/77 |
| 4,338,913 | 7/1982 | Good | 126/77 |
| 4,350,139 | 9/1982 | Robichaud | 126/77 |
| 4,360,000 | 11/1982 | Down | 126/77 |
| 4,380,228 | 4/1983 | Crowley | 126/77 |
| 4,424,792 | 1/1984 | Shimek | 126/80 |
| 4,455,995 | 6/1984 | Homolik | 126/61 |

*Primary Examiner*—James C. Yeung

[57] ABSTRACT

A stove and method for burning solid fuels having an insulated primary combustion chamber, uniform distribution of preheated primary air through upward facing holes in a grate, downward flow of combustion gas through the grate, retention of hot coals in the grate structure, preheated secondary air, individually controlled primary and secondary air flows, insulated vortex combustion chambers for secondary combustion, longitudinally finned tubes as a first stage heat exchanger, plate-fin assembly as a second stage heat exchanger, an induced draft fan to draw the air and combustion gases through the combustion chambers as well as the heat exchangers, and a forced air fan to blow cool room air through the two stage heat exchanger.

20 Claims, 11 Drawing Figures

FIG. 6
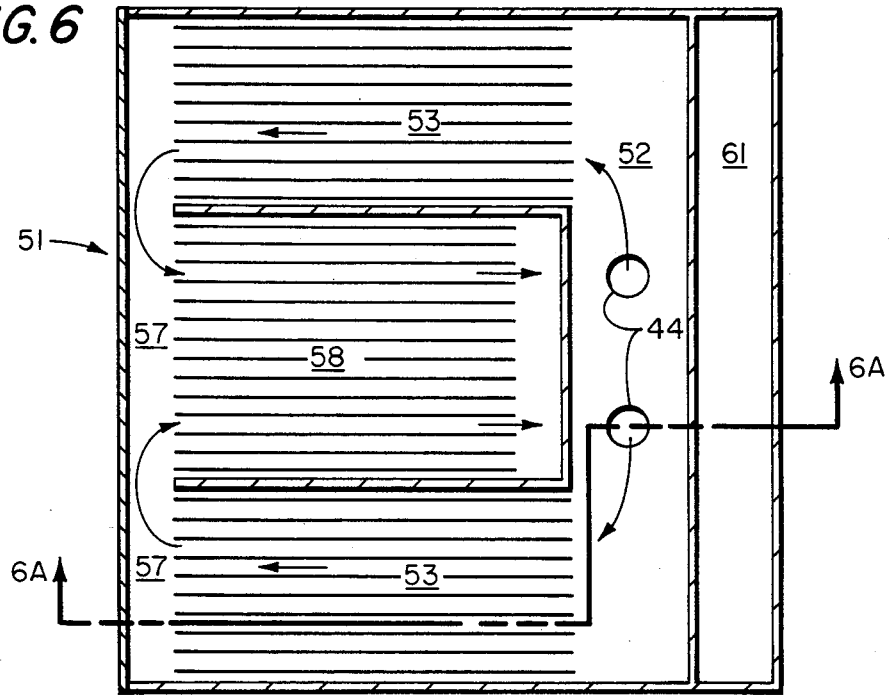
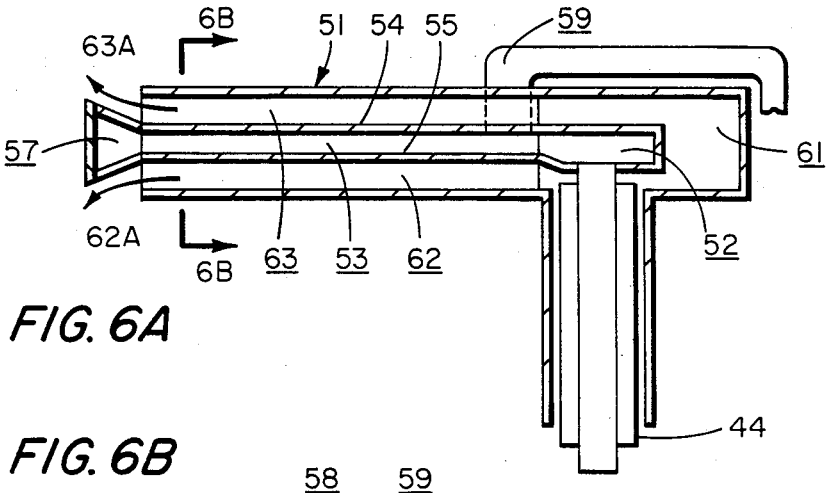
FIG. 6A
FIG. 6B
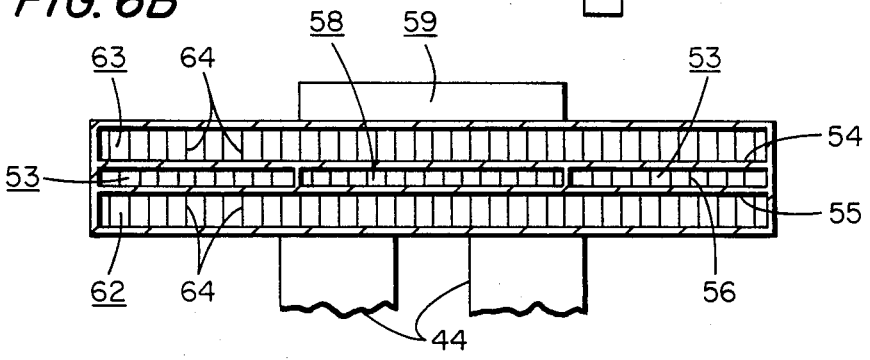

CLEAN BURNING SOLID FUEL STOVE AND METHOD

DESCRIPTION

1. Technical Field

The present invention is directed to a stove and method of burning solid fuel efficiently. The term "stove" is used in the following specification and claims as a general term which includes the special categories of a fireplace insert or a free-standing stove. A fireplace insert is a stove specifically designed to fit into the fireplace cavity of a home. A free-standing stove stands alone in the room.

2. Background of the Invention

As solid fuel stoves are becoming more numerous, they are causing a serious pollution problem in many urban areas. The problem arises because the stoves do not completely burn all of the fuel vapors from the burning wood. To provide good combustion, thorough mixing of the air and fuel vapor is required to achieve intimate contact between oxygen and fuel molecules. In addition, the mixture must be at an elevated temperature of over 1000° F.–1200° F. to cause the reaction to occur and sufficient time must be available to allow the reaction to go to completion.

Existing stoves use natural draft to cause turbulence and mixing of the fuel vapor and the oxygen in the combustion chamber. These drafts are extremely weak, amounting to a draft of only 0.01 inches of water gage (IWG). Also, the strongest drafts occur at the hottest zones of the fire, minimizing the turbulence in the cooler zones of the fire where it is most needed. Newer stoves have secondary combustion chambers with the addition of preheated, secondary air to improve mixing, but these stoves are still limited to the maximum overall draft available from the chimney.

A further impediment to clean combustion is the transfer of heat from the walls of the primary and secondary combustion chambers, as is practiced by stoves of current designs. Removal of heat from the primary and secondary combustors cools the gases, slowing the oxidation reactions or quenching them altogether. This heat removal is particularly damaging to good combustion if the flue is adjusted for slow burning over an extended duration. Catalysts have become popular for stoves, because they allow combustion of gases to occur at temperatures as low as 500° F., partially alleviating the problem. Catalysts, however, are costly, have a limited life and can become fouled, if certain solid fuels are burned in the stove.

All of the above problems, which cause dirty combustion, are exacerbated by the nonuniform combustion characteristics of wood fuel. A log placed on a bed of coals will first emit water vapor from its surface, followed by large quantities of volatile organics. Later, the emission of organics slows, finally terminating as the carbon burns as glowing embers. In a typical stove, thermostats are used to limit combustion air during the large efflux of organic vapor to reduce the heat release of the stove. This usually results in insufficient air being available to burn all of the fuel vapors that are released, increasing the pollutants in the exhaust.

High efficiency for a stove is important to reduce the cost of fuel or the manual labor required to supply the wood. Heat transfer from most stoves relies heavily on heat removal from the primary combustor and the secondary combustor. Many stoves use a double-wall construction with forced air flow between the walls. Nevertheless, the surface available for heat removal is insufficient for obtaining good efficiency at high burn rates as evidenced by stack temperature of 500° F. and above for these stoves.

The subject invention overcomes the above problems by a combination of design features as is revealed in the Summary of the Invention. Existing patents and other art contain many of the design features of the subject invention but they do not contain all of the features of the combination which results in clean burning and high efficiency. Good, in U.S. Pat. No. 4,338,913 teaches an insulated primary combustion chamber but does not teach an insulated secondary combustion chamber, vortex combustors for secondary combustion, an efficient heat exchanger or an induced draft fan for the combustion gases. Herne in U.S. Pat. No. 4,291,669, McKay in U.S. Pat. No. 4,300,526, Gullickson in U.S. Pat. No. 4,316,444, and many others teach secondary combustion in separate chambers with a preheated secondary air supply but do not teach insulated primary and secondary combustion chambers, vortex combustors for secondary combustion, an efficient heat exchange or an induced draft fan for the combustion gases.

Robichaud in U.S. Pat. No. 4,350,139 teaches the use of a grate through which primary and secondary air is passed for preheating the flow of the heated primary air into the primary combustion zone and the flow of the heated secondary air into the secondary combustion zone, downward flowing air through the grate, retention of coals in the grate and separate control of primary & secondary air. Robichaud does not teach an insulated primary and secondary combustion chamber, a vortex combustor for secondary combustion, an efficient heat exchanger or an induced draft fan for the combustion gases.

Down in U.S. Pat. No. 4,360,000 teaches the use of individual control of primary and secondary air whereby the supply of secondary air is increased as the supply of primary air is decreased. Down does not teach insulated primary and secondary combustion chambers, a vortex combustor for a secondary combustor, an efficient heat exchanger or an induced draft fan.

The subject invention therefore offers substantial improvement in clean burning and improved efficiency for solid fuel stoves not achieved in prior art.

SUMMARY OF THE INVENTION

In its basic concept, the method and apparatus of the present invention provide a fireplace insert or free-standing stove which retains a large portion of the heat within the combustion gas until after substantially all of the fuel vapors are burned. In addition, the gas is subjected to high levels of turbulent mixing in this hot condition. Only after this process is complete is the heat removed from the combustion gas and transferred into the room air. Control of the ratio of secondary air to primary air assures an adequate supply of oxygen for complete combustion.

Wood is burned on a grate in the primary combustion chamber which is insulated to substantially reduce the loss of heat therefrom. The grate is comprised of primary bars and secondary bars. The primary bars support the wood and contain primary air holes which direct jets of primary air against the lower surface of the burning wood. Primary air is introduced into the primary grate bars through the primary air manifold, cooling the metal of the grate bars and simultaneously preheating the primary air. Secondary grate bars are interspersed between the primary bars and constructed in such a way as to hold a bed of glowing char between the primary grate bars. Secondary air is passed through the secondary grate bars to cool the metal of the bars and to preheat the secondary air. Preheated secondary air is discharged from holes at the extremities of the secondary bar, adjacent to the inlets of the vortex secondary combustors.

The primary combustion chamber has no outlet at its upper extremities so all combustion gas must flow downwardly through the grate in its passage to the vortex combustion chambers. In passing downwardly through the grate the combustion gases containing unburned fuel molecules pass over the hot char, further heating the gas. In operation, the jets of preheated primary air uniformly distributed across the bottom of the wood cause uniform combustion over the entire surface because the air is uniformly metered through each of the individual jets. Also, the jets of air cause high heat transfer on the surface of the log promoting burning of large logs. After striking the surface of the burning log, the jets of combustion gas are deflected downward and sucked through the grate. This 180° change of direction causes turbulence and promotes good mixing of the fuel vapor with the primary air. The air jets also entrain fuel vapors as the jets issue from the primary grate bars.

During operation, the individual jets of air produce cavities in the lower surface of the logs because of the accelerated rate of burning when the jet strikes the log. As the combustion progresses these cavities grow to several inches in diameter. Intense combustion occurs within the cavities because they act as black bodies trapping the radiation from the burning surface. In addition, their shape causes additional swirling and turbulent mixing of the reacting gases. The net result is more complete combustion in the primary combustion chamber.

The design of the combustion chamber is ideally suited to burning very large logs. Upward facing air jets combined with downward flowing combustion gas allows a flat wood surface to be burned efficiently. No air passage upward through the logs is required or even desired. Large logs burn with excellent uniformity as the combustion surface area remains relatively constant throughout the burning of the log. The ability to burn large logs efficiently substantially reduces the labor of the wood cutter. In addition to burning large logs efficiently, this type of design allows the efficient combustion of wood species that are normally difficult to burn. Woods like eucalyptus and acacia have a clinging ash that normally prevents oxygen from reaching the fresh wood. Jet action easily burns through such ash layers. Also, woods with low volatile content are easily burned.

The hot combustion gas passing downwardly through the grate subsequently flows to the rear of the combustor where it is mixed with preheated secondary air and sucked into the inlets of the vortex combustion chambers. The short coupling of the hot gas flow below the grate with the inlets of the vortex combustors maintains the elevated temperature of the combustion gas. Ash falls from the grate directly into the ash pan below. The area of the grate is reduced from the total firebox area to cause a higher average downflow velocity of combustion gases and limit bypassing. Downward flowing gas directs ash into the ash pan below. Adequate distance between the bottom of the grate and the top of the ash drawer is provided to reduce the crossflow velocity, hence preventing ash transport into the vortex combustion chambers.

The mixture of primary combustion products and preheated secondary air is sucked into the insulated vortex combustion chambers where it is swirled at high velocity and reversed in direction to maximize mixing and turbulence to the hottest gas. It is in the vortex combustion chambers that the final combustion of all of the fuel vapors occurs. The combustion rate of the stove is entirely controlled by the primary air flow rate; the flow rate of secondary air is set to provide adequate oxygen to fully burn the fuel without undue excess air, which would reduce the thermal efficiency of the stove.

The hot gas leaving the vortex combustion chambers has reached its maximum temperature as only heat leakage through the insulated walls and through the small window have had any cooling effect. The hot swirling gas is cooled by passing through two heat exchangers, a first stage heat exchanger which is a pipe with longitudinal fins and a second stage heat exchanger which is of aluminum plate-fin construction. An air fan blows room air through the two heat exchangers in sequence to transfer the heat from the hot gas to the room air. The finned pipes of the first stage heat exchanger are mounted directly over each vortex combustion chamber with their axes coincident so that the swirl of the gas is maintained as it passes through the finned pipe.

In this way the heat transfer coefficient in the inside of the pipe is substantially increased. This is important to the performance of this heat exchange because the coefficient on the inside of the pipe largely controls the overall heat transfer. Cold air flow over the fins on the outside of the pipe is concurrent with the flow of combustion gas in the pipe, resulting in low metal temperatures.

Room air leaving the first stage heat exchanger is caused to pass above and below the plates defining the hot gas passage. Fins are placed in thin passages and brazed to the aluminum plates to assist in removing the heat from the aluminum plates. The heated air is discharged from the front of the second stage heat exchanger directly into the room. A plate covering the hot combustion gas plenum at the front of the heat exchanger may be removed for cleaning of the combustion gas passages.

The two heat exchangers are designed with adequate heat transfer capabilities to remove almost all of the heat from the exhaust gas during full throttle operation, resulting in exceptionally high stove efficiency. The induced draft fan provides the energy to move the combustion gas through the combustion chambers and the heat exchangers.

Control of the heat output of the stove is by controlling the fan speed of the induced draft fan. The primary air damper and the secondary air damper are set to provide a preset ratio of secondary air to primary air, say 50% to 50% for example. As the fan speed increases so does the primary air flow and hence the heat output of the stove. The speed of the convective air fan is determined by an automatic control that measures the temperature of the combustion gas leaving the secondary heat exchanger. The fan speed is set to maintain this temperature below a preset value, say 180° F. For the special condition when a new log is placed on the fire and large quantities of fuel vapor are evolved, a lever adjusts the ratio of secondary air to primary air, increasing it significantly to provide enough oxygen to burn the volatiles.

The use of a forced air fan with speed control provides a controlled flow of combustion air at all times, independent of the draft in the chimney. Consequently, since it decouples the combustion air flow rate from the draft, thermostatic controls are not required to maintain a uniform heat output from the stove.

The use of a fin plate heat exchanger and an induced draft fan would not be feasible in a wood stove if complete combustion could not be obtained. A conventional wood stove would shortly foul such devices with creosote.

Because the stove operates on a forced down draft principle, the hot combustion gas might escape into the residence when the door was opened to add new fuel. To prevent that occurrence, a by-pass is included connecting the upper region of the combustion chamber directly with the inlet of the induced draft fan when the by-pass door is opened. When the bypass door is opened, the fan sucks the combustion gases from the upper portion of the combustion chamber preventing their escape into the residence. To protect the fan from over-temperature, a small door to room air is opened allowing room air to dilute the combustion gas to a safe temperature. When the bypass is opened the heat exchangers are bypassed. In normal operation, the entire stove is under negative pressure preventing the leakage of combustion gas into the residence.

During cold start-up the vortex secondary combustion will not burn fuel vapors because they are too cold. Correct starting procedure is to burn approximately 3 lbs. of kindling at full primary airflow with only 10% secondary air flow to heat the combustors to operating temperature in approximately 15 minutes. The stove will issue light smoke during this period until the vortex combustors reach operating temperature (approximately 1000° F.). Once operating temperatures has been achieved, the stove may be throttled to below 25% of its normal rating yet retain a clear stack. This is because the insulation prevents heat loss and maintains the gas at a high enough temperature for complete combustion reactions. During normal operation the stove operates with approximately 100% excess air.

In normal operation, a standard size stove in accordance with this invention will require about 200 to 300 watts of electric power for operation, the power required by 2 or 3 lightbulbs. This is equivalent to approximately 2% of the energy release of the stove. At an electricity cost of 6 cents per kilowatt hour the cost to run the stove for 1 day is perhaps 30 cents. Savings in fuel due to the increased efficiency of the stove compared to conventional stoves will compensate in large measure for the cost of electric power.

The plate-fin heat exchanger acts as a flame arrestor and spark quencher to prevent any ignition source from leaving the stove in the exhaust pipe. This fact, coupled with low gas exit temperatures less than 250° F., allows low cost PVC pipe to be used for the chimney in place of expensive insulated stainless steel pipe which is designed to withstand a 2100° F. chimney fire.

These and other features and advantages of the present invention will become more apparent upon a perusal of the following description wherein similar characters of reference refer to similar parts in each of the several views.

BRIEF DESCRIPTION OF THE DRAWINGS

FIG. 6 is a horizontal sectional view of the second stage heat exchanger of the stove shown in FIG. 1 taken along line 6—6 in the direction of the arrows.

FIG. 6A is an elevational, sectional view of the heat exchanger shown in FIG. 6 taken along line 6A—6A in the direction of the arrows.

FIG. 6B is an elevational, sectional view of a portion of the structure shown in FIG. 6A taken along line 6B—6B in the direction of the arrows.

DETAILED DESCRIPTION OF THE PREFERRED EMBODIMENT

Figure 1:
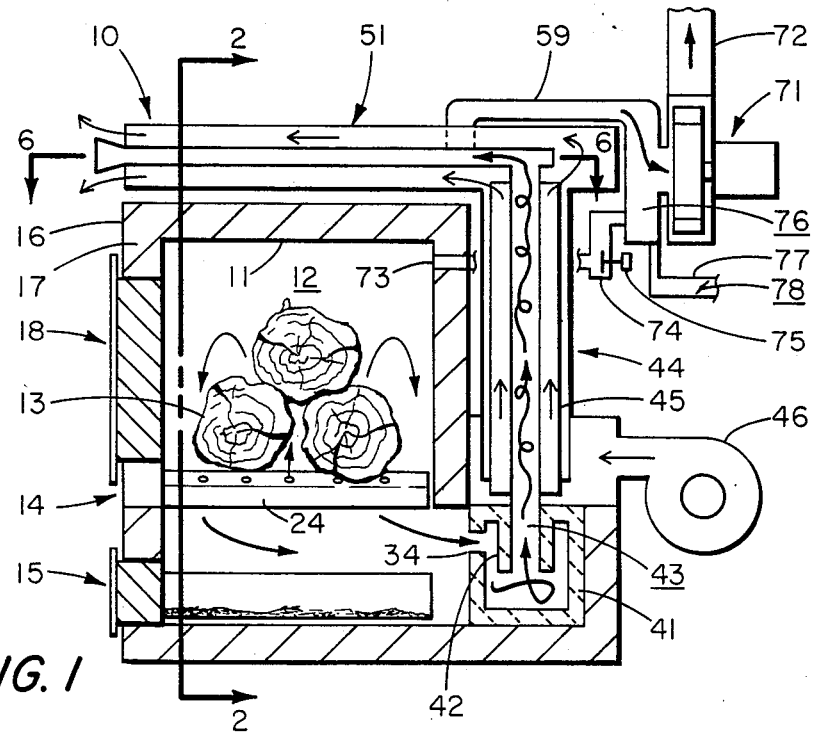
FIG. 1 is a side elevational, sectional view of the stove.
Figure 2:
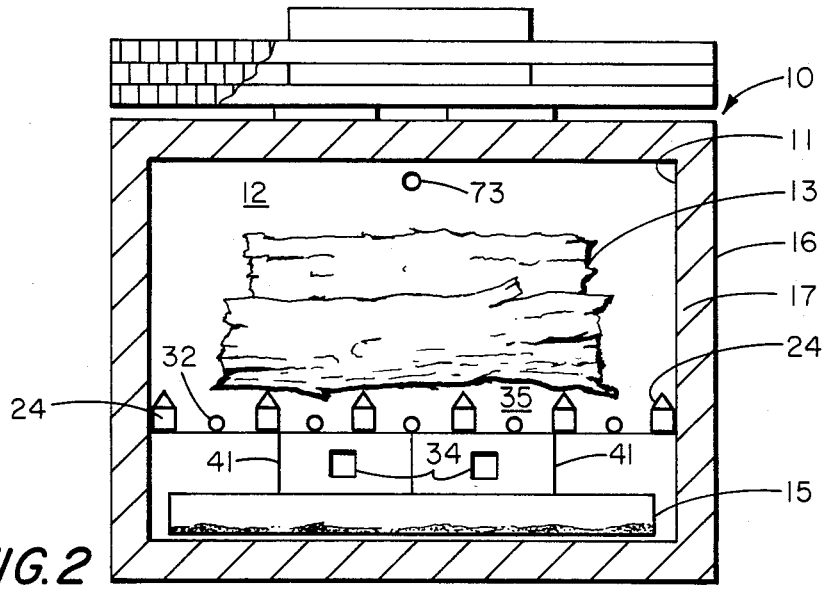
FIG. 2 is an elevational, sectional view from the front of the stove in FIG. 1 taken along line 2—2 in the direction of the arrows.

While the stove of this invention can be a fireplace insert or free standing unit, the stove is shown in FIGS. 1 and 2 without reference to placement. The stove 10 is comprised of an inside shell 11 forming a primary combustion chamber 12 in which wood 13 is burned. The wood rests on a grate 14 and the ash falls through the grate into an ash drawer 15. The outer structure of the stove 10 is a shell 16 such as of metal which provides an airtight enclosure and structural support for the stove. The outer structure of the stove is insulated from the elevated temperatures within by insulation 17 which typically is a minimum of 1½" of high temperature fibrous insulation. The insulation maintains the heat within the combustion chambers for maximum combustion of the organic vapors. An added benefit of the insulation is that the skin temperature of the stove does not exceed approximately 250° F.; hence, the stove may be used adjacent to combustible surfaces in the residence. The wood 13 is placed in the primary combustion chamber 12 through a door 18 in the front of the stove which may have a modest window for viewing the fire. The window is not shown in FIG. 1.

Figure 3:
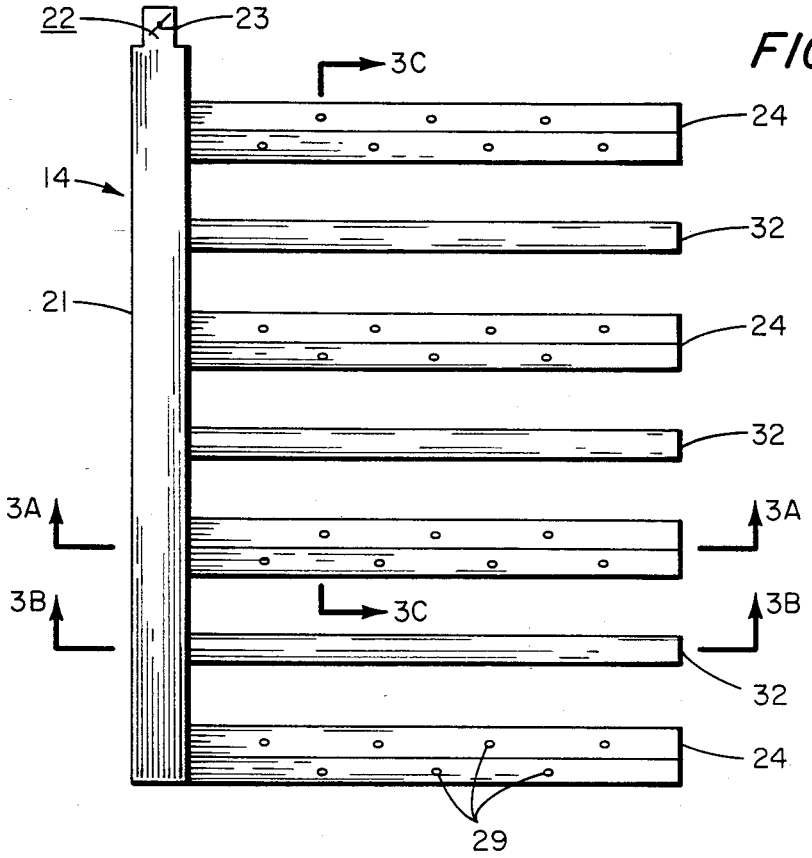
FIG. 3 is a top view of the grate shown in FIGS. 1 and 2.
Figure 3A:
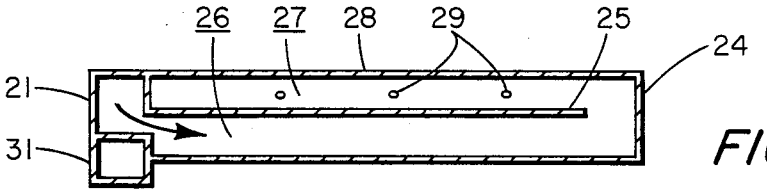
FIGS. 3A, 3B and 3C are elevational, sectional views of the grate shown in FIG. 3 taken along lines 3A—3A, 3B—3B and 3C—3C, respectively, in the direction of the arrows.
Figure 3B:
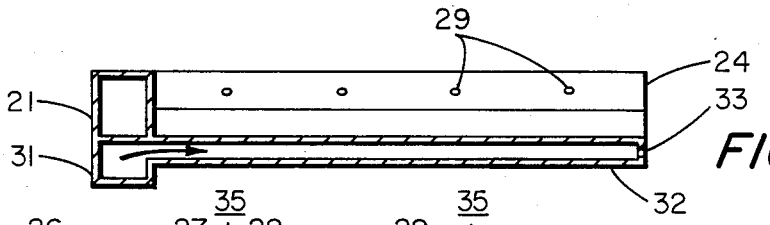
Figure 3C:
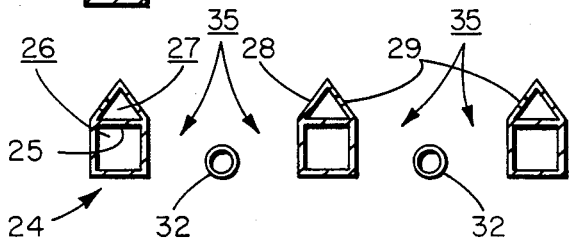
Figure 5:
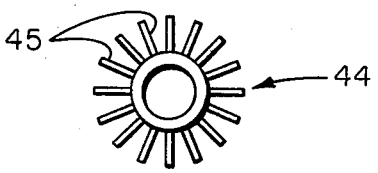
FIG. 5 is a sectional view of the finned tube in FIG. 4 taken along the line 5—5 in the direction of the arrows.
Figure 4:
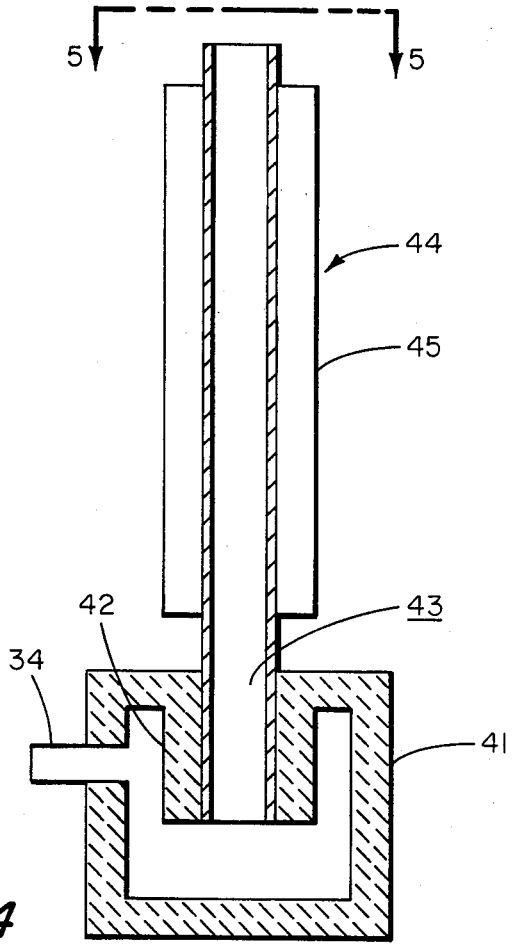
FIG. 4 is an elevational, sectional view showing a finned tube of the first stage heat exchanger mounted on a vortex combustor.

Referring now to FIGS. 2, 3 and 3A-3C, the grate 14 is composed of a primary air manifold 21 and a secondary air manifold 31, each of which has an independently controlled inlet chamber. Only the primary air inlet chamber 22 with damper control means 23 is shown in FIG. 3. Primary air from the primary air manifold 21 is distributed to a plurality of hollow primary grate bars 24 extending from the manifold 21. Each bar 24 is longitudinally subdivided by a subdivider 25 from the inlet end to adjacent the remote end into a lower portion 26 and an upper portion 27 having upward angled top surfaces 28 provided with a multiplicity of outlet jet holes 29. Air is ducted to the remote end of the grate bars 24 through the lower portion 26 of the grate bar 24 under the air divider 25. The air is turned in direction at the remote end of the grate bar and leaves the grate bar upper portion 27 through the jet holes 29, nominally ¼ inch holes. The air flowing through the grate bar 24 cools the metal of the grate bar and is itself preheated to elevated temperatures to assist in providing good primary combustion.

The pressure drop in the manifold 21 is controlled by the outlet jet holes 29; hence, a uniform flow of preheated air is provided from each of the holes. This uniform flow of air is not influenced by the condition of the fire above it and hence provides a uniformly distributed flow of primary air across the entire lower surface of the burning wood. In the preferred embodiment pressure drop through the grate is approximately 0.1 IWG. The preheated air jets are directed 45° above the horizontal into the lower surface of the wood where their impingement causes accelerated burning of the surface. The jets induce fuel rich gases into their core causing substantial turbulent mixing and promoting good combustion conditions. This turbulence is also enhanced by the turning of the jets as they strike the bottom surface of the log and are sucked down below the grate by the flow into the vortex combustion chamber described below. The effect of the jet action on the lower surface of the wood combined with the downward flow of combustion gas has the effect of limiting the intense combustion zone to only the lower surfaces of the logs, preventing uncontrolled gasification of the upper portion of the wood. Cavities are produced in the logs by the jets. The cavities act as black bodies to trap radiation and raise the combustion temperature. An unforeseen benefit is the ability to burn large logs up to 12 inches wide with ease and uniformity. Hence, less work is required in splitting wood for burning in the subject invention.

Yet another advantage of the grate design is the ability to provide controlled heat release by simply adjusting the flow rate of the primary air. In a conventional stove, as the fire burns hotter it heats the chimney gas and induces a higher flow rate of air, further increasing the heat release. Thermostats are designed to reduce this tendency by sensing flue temperature and closing the damper. In the present invention the flow of primary air through the manifold is independent of the heat release in the fire so no thermostat is required.

Secondary combustion air is supplied through the secondary air manifold 31 to a plurality of hollow secondary grate bars 32 extending from the manifold 31 parallel to and spaced in between the primary grate bars 24. The air flows through the secondary grate bars 32, cooling the metal and concurrently preheating the air. The preheated air leaves the secondary grate bars 32 through two horizontal outlet holes 33 at the end of the secondary grate bar 32 remote from the manifold 31. The preheated secondary air jets mix with the hot products of combustion from the primary combustion chamber 12 immediately upstream of entrances 34 to vortex secondary combustors 41, two of which are positioned side-by-side in the preferred embodiment behind the primary combustion chamber 12. The turbulent mixing of the secondary air and the primary air combustion products provides further combustion and provides a fuel gas-oxygen mixture suitable for final combustion in the vortex combustion chambers 41. Preheat air temperatures in excess of 500° F. have been measured leaving the secondary grate bars.

The size and location of the secondary grate bars 32 has been selected to provide a cavity 35 bounded by two primary grate bars and a secondary grate bar. This cavity 35 holds the glowing coals from the burning wood. The coals in the cavity 35 provide preheat to both the primary and secondary combustion air. In addition, the downflow of combustion gas from the primary combustion chamber 12 passes over the coals further heating the combustion gases. Also, the flow of oxygen laden gas over the coals causes them to burn more thoroughly than if they were submerged in the ashes at the bottom of the combustion chamber.

The hot primary combustion gases and the preheated secondary air enter two vortex combustion chambers 41 through small openings 34 which are located below the grate and at the rear of the stove 10. The gases and preheated air are accelerated to a high velocity in the inlet 34 and caused to swirl about a central core 42 creating a vortex flow which goes to the bottom of the chambers 41 and eventually exits through a central pipe 43, still in a high swirl condition. The vortex combustion chambers 41 are fabricated from castable refractory to withstand high temperatures of over 2,000° F. Thorough mixing at the highest gas temperatures in the stove occurs in the vortex combustion chambers 41 to burn essentially all of the organic fuel vapor in the combustion gas.

The vortex combustors 41 exhaust into two finned pipe heat exchangers 44 having fins 45 parallel to the axes of the pipe. The high swirl in the gas flow enhances the internal heat transfer coefficient to substantially improve the performance of the heat exchangers 44. A convective air fan 46 blows air over the outside surface of the finned pipes, keeping the metal of the pipes cool while transferring heat from the hot combustion gas to room air. Both the hot combustion gas and the cooling air flow are ducted into an aluminum plate-fin heat exchanger 51 where the heat transfer process is completed.

The still hot combustion gas flows from the finned tubes of the heat exchangers 44 into a hot gas plenum 52 of the plate-fin heat exchanger 51 positioned above the outer shell 16 of the primary combustion chamber 12. The plenum 52 splits the hot gas into two streams, each of which flows through a finned passage 53 between upper and lower plates of aluminum 54 and 55, respectively. Fins 56 are brazed to the upper and lower plates and are parallel to the direction of flow of the hot gas. Each of the passages 53 occupies the outer portion of the heat exchanger 51, as shown in FIGS. 6 and 6B. Heat is transferred from the hot combustion gas into the upper and lower plates 54 and 55 of the passages 53, assisted by the vertical fins 56. As the combustion gas leaves the passages 53 it collects in the plenum 57 across the front of the heat exchanger 51. Gas leaves the plenum 57 in a finned passage 58 located in between and similar to the passages 53 but with the gas flowing in the opposite direction. After passing through passage 58 the cooled hot gas is collected in a plenum 59 directed to the top of the heat exchanger 51 and then rearward to an induced draft fan 71 described below.

The cooling air from finned heat exchangers 44 flows into the cooling air plenum 61 of the aluminum plate-fin heat exchanger 51. A portion of the cooling air leaves this plenum 61 through a lower finned passage 62 below the hot gas passage and the remainder through an upper finned passage 63. Each of these passages 62 and 63 contain a large number of vertical fins 64, parallel to the direction of gas flow. These fins are brazed to the two plates which form the boundary with the hot gas passages 53 and 58. Heat is transferred into the cooling air through the plates separating the passages and through the fins. Heated air exhausts from passages 62 and 63 into the room through exits 62*a* and 63*a*, respectively. A removable plate 64 on the front of plenum 57 allows cleaning of the hot gas passageways should they become plugged with combustion products.

The induced draft fan 71 provides a suction such as of 3.5 inches of water column, to suck the primary and secondary air through their dampers and through the grate 14. It also sucks the combustion products through the primary combustion chamber 12, through the vortex combustors 41, through the finned tube heat exchangers 44 and through the plate-fin heat exchanger 51. Besides providing the energy to move the combustion gases through the stove, the induced draft fan 71 blows the cooled spent combustion gas up a stack 72. As a result, large flues are not required and inexpensive small sized pipes may be used in their place. Because the exhaust is clean and virtually free of unburned combustion products the fan and the exhaust stack do not plug with creosote. In the preferred embodiment, the temperature of the exhaust gas does not exceed 250° F., hence certain types of plastic pipe may be used for the exhaust rather than conventional stainless steel double walled pipe, which is very expensive. Fire hazard is nil because of the absence of creosote and the low temperature. Also, the plate-fin heat exchanger 51 acts as a flame arrestor to prevent any ignition source such as a flame or spark from entering the exhaust stack.

To prevent smoke from issuing into the room when the door of the stove is opened, a bypass directly from the upper portion of the primary combustion chamber 12 to the inlet of the induced draft fan is provided. An opening 73 near the top of the combustion chamber 12 communicates to a plenum 76 of the induced draft fan 71 through a conduit 74 containing a shut-off valve 75. When this valve 75 is opened, the induced draft fan sucks smoke and products of combustion directly from the primary combustion chamber 12 preventing its issuing into the room. To protect the fan 71 from overtemperature in the event that the bypass is inadvertently left open, a second conduit 77 into the plenum 76 is provided to duct cool room air into the plenum 76 and dilute the hot combustion gases. Valve 78 in conduit 77 is opened and closed concurrently with valve 75 by a suitable mechanism.

The control of the heat release from the stove is by control of the speed of the induced draft fan 71 using a simple reostat. High fan speeds result in high primary flow rates and high burning rates; the converse is true for slow fan speeds. By use of the dampers into manifolds 21 and 31, the ratio of the secondary air to primary air is set at some appropriate value, say 60% of primary air and 40% secondary air for example, for normal operation. During periods when new wood is placed on the fire a convenient handle (not shown) will alter this to 40% of primary air and 60% secondary air in order to burn the large flux of volatiles emitted from the wood. After approximately ½ hour the handle may be returned to its normal position.

The convective air fan 46 is automatically controlled by sensing the temperatures of the combustion gas exiting from the aluminum plate-fin heat exchanger 51. As that temperature increases above 150° F. the fan is started. The fan speed is increased in 3 steps until it is operating at full rate speed for any temperature in excess of 170° F.

In operation, the stove 10 is quite stable and tends to maintain a reasonably constant heat output throughout a burn of a charge of logs. However, fully automatic operation may be achieved by sensing the temperature of the heated air leaving the plate-fin heat exchanger 51 and adjusting the speed of the induced draft fan 71 to maintain that temperature a constant.

The stove 10 burns a wide variety of solid fuels including wood, coal, newspapers and combustible solid wastes. Stoves with catalytic converters cannot burn many fuels such as coal containing sulfur or newspaper, because the chemicals therein poison the catalyst causing it to become inoperative. Hence the subject invention has substantial advantage over catalytic stoves.

OPERATIVE EXAMPLE

While the foregoing description is believed adequately to describe the present invention, an illustrative operative example of a unit using the invention will be given. The unit is designed as a fireplace insert but can also be used as a free-standing stove with zero clearance if desired. The body is made from ⅛ inch mild steel and insulated with two inches of Kaowool high temperature insulation. The firebox is 24 inches wide, 14 inches deep and 10 inches high. The grate is constructed of stainless steel and the vortex combustion chambers are cast from refractory. The finned tube heat exchangers are steel and the plate fin heat exchanger is aluminum. The induced draft fan has a flow rate capability of 37 CFM at a pressure of 3.5 inches of water gage. The convective air fan has a flow rate of 200 CFM at a pressure of 0.7 inches of water gage. The fans are located in the rear of the stove to suppress noise when operated as a fireplace insert. The plate-fin heat exchanger sits on top of the main stove body.

The stove easily burns wood as wet as 50% moisture content (wet basis) as well as normal air dried wood (20% moisture content (wet basis)). It has operated successfully on pine with high resin content, oak with nominal resin content and acacia with very little resin content. Start up is accomplished with approximately 3 pounds of kindling at full fan speed. The kindling heats the vortex combustion chambers to about 1000° F. in 15 minutes, also providing quick heat for a cold homeowner. Light smoke issues from the exhaust during this period when the temperature in the vortex combustion chambers is inadequate to burn all of the volatiles. After reaching about 1000° F., the stack becomes clear and remains clear throughout the remainder of the operation. During the heat-up 90% primary air and 10% secondary air is used. Excess air is approximately 100%.

When the kindling has finished burning, a single oak log (nominally 20% Moisture content and wet basis) is placed in the stove and the ratio of burning primary air to secondary air is temporarily adjusted from 90:10 to 40:60. In one test, a log measured 17"×7"×5" and weighed 14 pounds. The stove provided a heat output of approximately 28,000 BTU/HR at a nominal fan setting and continued to do so for approximately 3 hours. The air temperature leaving the plate-fin heat exchanger was approximately 190° F. The temperature of the exhaust gas up the stack was approximately 180° F. and the excess air was 100%.

When operating the stove at the design point, data from one test indicated an excess air ratio of 55% excess air, carbon monoxide concentration of 30 ppm and an estimate total particulate weight of less than 0.18 lbs per milion BTUs. Heat release rate was 50,000 BTU/HR and the vortex combustors were operating in the 1600° F. to 2000° F. range. Stack gas temperature was 215° F. and the stack was clear. Stove efficiency was 86%.

When operating the stove in a throttled condition simulating a long-slow burn, the excess air was 180% and the measured carbon monoxide level varied between 500 ppm and 1000 ppm. The vortex combustion chambers operated at 1000° F. to 1200° F. with a clear stack. Stack gas temperature was 129° F. and stove efficiency was 88%. Heat release rate was 15,000 BTU/HR.

In normal operation the following pressure drops were measured in the combustion gas circuit:

Across the inlet dampers: 1 inches water gage
Across the grate: 0.2 inches water gage
In the primary combustor: −1.2 inches water gage
Across the vortex combustor: 0.4 inches water gage
Across the heat exchanger: 1.5 inches water gage
At the 1D Fan Inlet: −3.1 inches water gage The combined pressure drop on the air side through the two stages of heat exchanger was 0.6 inches of water gage. Each fan consumed approximately 200 watts for a total power consumption of 400 watts.

While the invention has been particularly shown and described with reference to a preferred embodiment thereof, it will be understood by those skilled in the art that various changes in form and details may be made therein without departing from the scope of the invention.

We claim:

1. A solid fuel burning stove comprising:

an insulated primary combustion chamber for containing the solid fuel to be converted to combustion vapor;

a grate for supplying and for controlling the supply of atmospheric primary air and for preheating, for controlling the supply of and for delivering atmospheric secondary air to said primary combustion chamber;

an insulated secondary combustion chamber, located downstream from said primary combustion chamber, for receiving the preheated atmospheric secondary air and the combustion vapor from said primary combustion chamber, said secondary combustion chamber having at least one vortex combustor for swirling the combustion vapor with the atmospheric secondary air, for burning substantially all of the combustion vapor, for elevating the velocity of the mixture of combustion gas and secondary air, and for elevating the temperature of the mixture of combustion gas and secondary air to the highest temperature within said stove;

means for conveying the high temperature combustion gas from said secondary combustion chamber to exhaust from said stove with substantially no pollutants and at a substantially reduced temperature including a heat exchanger located downstream from said secondary combustion chamber for receiving the high temperature combustion gas and for transferring the heat from the combustion gas to the room air; and induced draft fan means for moving the combustion gas through said combustion chambers and said heat exchanger, and a convective air fan to move the room air to be heated through said heat exchanger.

2. The stove of claim 1 including means for mounting the stove in a fireplace.

3. The stove of claim 1 including means for supporting the stove as a free standing stove.

4. The stove of claim 1 wherein said grate comprises:

a plurality of substantially parallel, hollow first support members defining a first generally planar surface for supporting the lower surface of the solid fuel, a plurality of substantially parallel, hollow second support members defining a second generally planar surface located below said first surface, said second support members being located between alternate ones of said first support members and defining, in combination with said first support members, a plurality of troughs for supporting glowing coals, a multiplicity of orifices extending through each of said first support members, each orifice being directed toward said first planar surface for creating a zone of turbulence in one of said troughs beneath the lower surface of the solid fuel, and said induced draft fan causes a pressure drop for passing primary air within said first support members to preheat the primary air, for passing secondary air within said second support members to preheat the secondary air, and for drawing the combustion vapor downwardly from the primary combustion chamber through said grate

5. The stove of claim 4 wherein:

said grate is located above said vortex combustor so that a downdraft is created in said primary combustion chamber.

6. The stove of claim 1 including two vortex combustors with their spin axes vertical.

7. The stove of claim 1 wherein:

said heat exchanger is comprised of a first stage portion and a second stage portion and said first stage portion is comprised of at least one pipe with external fins parallel to its axis, said pipe being coaxial with the axis of said vortex combustor whereby the high temperature, combustion gas leaving said vortex combustor flows through the inside of said pipe with the gas swirl component maintained and the room air flows adjacent the outside of the finned pipe to be heated.

8. The stove of claim 1 wherein:

said heat exchanger is comprised of a first stage portion and a second stage portion; and said second stage portion is an aluminum heat exchanger which receives hot combustion gas and cool room air from said first stage portion.

9. The stove of claim 1 wherein said induced draft fan has a manual speed control for controlling the flow of primary air to said primary combustion chamber and the flow of secondary air to said primary combustion chamber is controlled in proportion to the flow of primary air to burn all of the combustion vapor.

10. The stove of claim 1 including an automatic speed control for said convective air fan, means for sensing the temperature of the hot combustion gas exiting the heat exchanger and means for adjusting said automatic speed control for maintaining the exhausting combustion gas temperatures at a predetermined value.

11. The stove of claim 10 including means for increasing the ratio of secondary air to primary air for temporary periods when a new fuel charge has been introduced into the stove.

12. The stove of claim 11 wherein said means for increasing the ratio of secondary air to primary air also includes means for reducing the primary air flow to limit the surge of heat release from volatiles when new fuel is added to a fire.

13. The stove of claim 1 wherein:

said primary combustion chamber contains conduit means for connecting the uppermost portion of said primary combustion chamber with the inlet to said induced draft fan;

a shut-off valve is disposed in said conduit means; and means for bleeding ambient air into the inlet of said induced draft fan is provided to lower the temperature of the combustion gas when said shut-off valve is opened.

14. The method of burning solid fuel comprising the steps of drawing primary air upwardly in a primary combustion chamber during combustion of the solid fuel therein, drawing combustion vapor downwardly from said primary combustion chamber into a vortex secondary combustion chamber, mixing secondary air with said combustion vapor prior to introduction of the gases into said vortex secondary combustion chamber, swirling said combustion vapor and said secondary air in said vortex chamber at a high speed to burn substantially all of said combustion vapor and for elevating the mixed secondary air and combustion vapor to its highest temperature within said stove, exchanging the heat of said combustion gases with room air within a heat exchanger, and said steps of drawing said primary air, said secondary air and said combustion gases through said combustion chambers and heat exchanger is accomplished with exhaust fan means.

15. The method of claim 14 including the steps of preheating said primary and secondary air in the primary combustion chamber.

16. The method of claim 14 including the step of drawing combustion gas directly from said primary combustion chamber when fuel is being added to said primary combustion chamber during the combustion operation.

17. The method of claim 14 wherein the primary air is directed in jets into the solid fuel.

18. The method of claim 14 wherein said step of drawing primary air takes place under a pressure drop of at least 0.05 inches of water gage.

19. The method of claim 14 wherein said vortex secondary combustion chamber has a pressure drop of at least 0.1 inches of water thereacross.

20. The method of claim 14 wherein said heat exchanger has a pressure drop of at least 0.2 inches of water gage.

* * * * *